US012722879B2

(12) United States Patent
Füller et al.

(10) Patent No.: US 12,722,879 B2
(45) Date of Patent: Sep. 1, 2026

(54) RECTANGULAR RUPTURE DISK

(71) Applicant: REMBE GmbH Safety + Control, Brilon (DE)

(72) Inventors: Michael Füller, Paderborn (DE); Stefan Penno, Brilon (DE)

(73) Assignee: REMBE GmbH Safety + Control, Brilon (DE)

( * ) Notice: Subject to any disclaimer, the term of this patent is extended or adjusted under 35 U.S.C. 154(b) by 45 days.

(21) Appl. No.: 18/740,041

(22) Filed: Jun. 11, 2024

(65) Prior Publication Data

US 2024/0409308 A1 Dec. 12, 2024

(30) Foreign Application Priority Data

Jun. 12, 2023 (EP) ..... 23178734

(51) Int. Cl.
*B65D 90/36* (2006.01)

(52) U.S. Cl.
CPC ..... *B65D 90/36* (2013.01)

(58) Field of Classification Search
CPC ..... B65D 90/36
USPC ..... 220/89.2
See application file for complete search history.

(56) References Cited

U.S. PATENT DOCUMENTS 3,698,598 A * 10/1972 Wood ..... F16K 17/162 220/89.2
4,067,154 A * 1/1978 Fike, Jr. ..... H05K 5/068 52/99
4,085,764 A * 4/1978 Raidl, Jr. ..... F16K 17/1613 137/68.28
D373,984 S * 9/1996 Darien ..... D12/400
6,367,203 B1 * 4/2002 Graham ..... B65D 90/36 52/98
7,234,278 B2 * 6/2007 Eijkelenberg ..... F16K 17/16 52/99

FOREIGN PATENT DOCUMENTS

FR 2870833 A1 12/2005
FR 2943043 A1 9/2010

OTHER PUBLICATIONS

FR 2870833 Specification (English Translation) (Year: 2005).*
European Search Report with English translation in European Application No. 23178734.2, dated Nov. 15, 2023, 9 pages.

* cited by examiner

*Primary Examiner* — Nathan J Jenness
*Assistant Examiner* — Jennifer Castriotta
(74) *Attorney, Agent, or Firm* — Edell, Shapiro & Finnan, LLC

(57) ABSTRACT

A rectangular rupture disk comprising sheet metal includes an edge region with which the rupture disk is fastenable to an opening of a container or of a conduit. In the edge region, the rupture disk has a fold-over including a first folded over part of the sheet metal and a second part of the sheet metal to which the first folded over part is parallel or predominantly parallel. The rupture disk further includes a central region with which the opening is sealable until the container or conduit reaches a bursting pressure, and predetermined breaking lines along which the rupture disk ruptures to at least partially open the central region in response to the container or conduit reaching the bursting pressure.

10 Claims, 6 Drawing Sheets

RECTANGULAR RUPTURE DISK

CROSS REFERENCE TO RELATED APPLICATIONS

This application claims priority under 35 U.S.C. § 119 (a)-(d) to European application No. 23178734.2 filed on Jun. 12, 2023, the entire contents of which are hereby incorporated by reference.

TECHNICAL FIELD

The present disclosure relates to an angular, in particular rectangular rupture disk, which is made of a sheet metal, comprising an edge region, with which the rupture disk can be fastened to an opening of a container or of a conduit, and comprising a central region, with which the opening can be shut off up until reaching a bursting pressure, and comprising predetermined breaking lines, along which the rupture disk ruptures when the bursting pressure is reached, so that the central region opens completely or in parts.

BACKGROUND

The applicant manufactures such angular rupture disks and distributes them under the designation "EGV." EGVs are used, for example, in installations with silos, spray dryers, elevators, troughed chain conveyors, strainers with light vibration, containers with mechanical filling or cyclones, in particular in unpressurized processes and processes with low negative or positive pressure. The rupture disk can be used to prevent a pressure increase in containers or conduits above the bursting pressure. If there is a pressure increase above the bursting pressure, the EGV opens at the defined predetermined breaking lines and releases the pressure from the container or conduit into the environment.

In its current implementation, the EGV consists of several parts. It comprises a cut and transformed sheet metal, which comprises two circumferential beads and four so-called add-on metal plates, each of which is respectively added on to one side of the sheet metal. The sheet metal covers the central region and part of the edge region of the rupture disk. Other parts of the edge region are formed by the add-on strips. The predetermined breaking lines, which rupture when the bursting pressure is reached, are provided in the sheet metal. In cross-section, the add-on metal plates are U-shaped strips with a very narrow web, which is approximately as wide as the sheet metal is thick, and with legs of different lengths that reach around the edge of the sheet metal.

Several work steps are required to manufacture the EGV. Firstly, the sheet metal is manufactured in several steps. Secondly, the add-on strips are manufactured in several steps. The add-on strips are then attached to the sheet metal. Finally, these add-on strips are secured to prevent them from becoming detached from the sheet metal during transportation or assembly of the rupture disk and possibly being lost or damaged. Clamps are currently used for this purpose, which must also be manufactured, fitted and then once again removed at the end.

Due to the large number of steps involved, the production of EGVs is overly complex.

SUMMARY

The disclosure is therefore based on the task of designing an angular rupture disk such that it can be manufactured more easily.

This task is solved in accordance with the disclosure in that the rupture disk in the edge region comprises a fold-over, which comprises a first folded over part of the sheet metal and a second part of the sheet metal, to which the folded over part is parallel or predominantly parallel. Such a fold-over is also referred to by those skilled in the art as a fold.

In a rupture disk according to the disclosure, the add-on strips are thus omitted and the edge region of the rupture disk is formed by the sheet metal, the edge of which is folded over for this purpose. The transforming of the sheet metal into the rupture disk according to the disclosure is therefore more complex than the production of the sheet metal of the EGV alone. However, the production of the rupture disk is less complex overall because there is no need to manufacture the add-on strips and mount the add-on strips on the sheet metal. The rupture disk can thus be transformed from a sheet metal, in particular at a single workstation, and no parts, such as add-on strips, need to be produced and supplied at another workstation or supplied from a stock. In addition, a rupture disk according to the disclosure does not require any transport protection to secure the add-on strips.

In a rupture disk according to the disclosure, holes may be provided in the fold-over, which holes are suitable for screws for screwing the rupture disk to an edge of the opening.

It is possible that in a rupture disk according to the disclosure a first shoulder area is provided in the first or second part of the sheet metal. If the shoulder area is provided in the first or second part, a space can be provided starting from the edge of the rupture disk up to the first shoulder area between the first part and the second part, whereas the first part and the second part can then lie against each other from the first shoulder area onwards.

A rupture disk according to the disclosure can have a second shoulder area in the central region at a distance from the fold-over. The second shoulder area can run in the same direction as the first shoulder area. However, it is also possible for the second shoulder area to run in the opposite direction to the first shoulder area. When compared to the beads provided in the sheet metal of the known EGV, less transformation energy is used to produce the shoulder areas. This has the advantage that, in contrast to a sheet metal of the EGV in which the beads are introduced, there is less, undesirable, deformation of the sheet metal when these shoulder areas are produced.

As a result of the transformation process used to insert the beads, the rupture disks may no longer be flat in a non-assembled state, but rather can form a so-called unevenness, which means that corners of the rupture disk or alternatively the sheet metal protrude from the plane that should be formed by the sheet metal. Although this has no significance for the function of the rupture disk, it does at least slightly complicate the assembly of the known rupture disk.

BRIEF DESCRIPTION OF THE DRAWINGS

An embodiment example of the disclosed rupture disk is described below with reference to the drawings.

DETAILED DESCRIPTION

Figure 1:
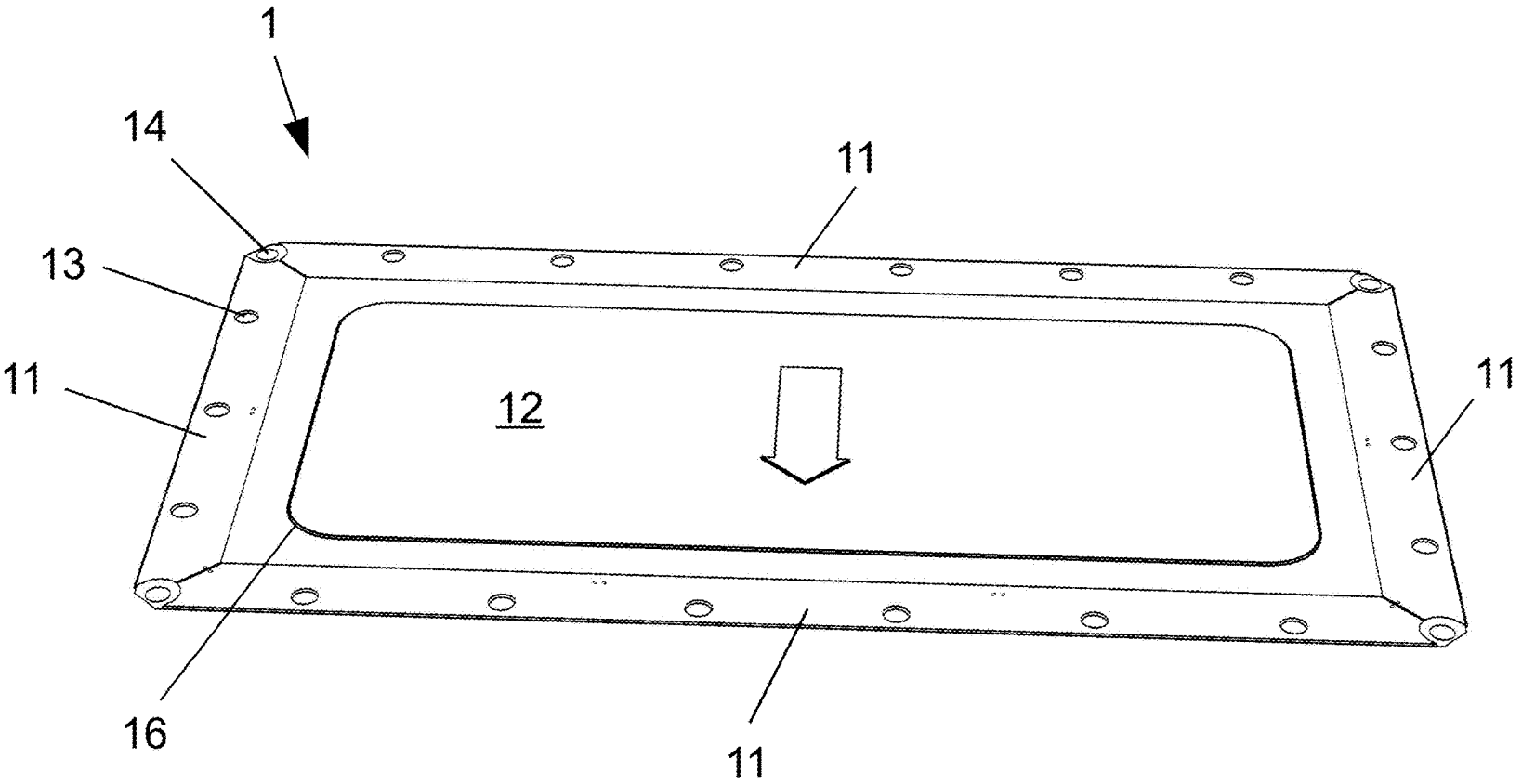
FIG. 1 shows a perspective view of a rupture disk according to the disclosure.
Figure 1A:
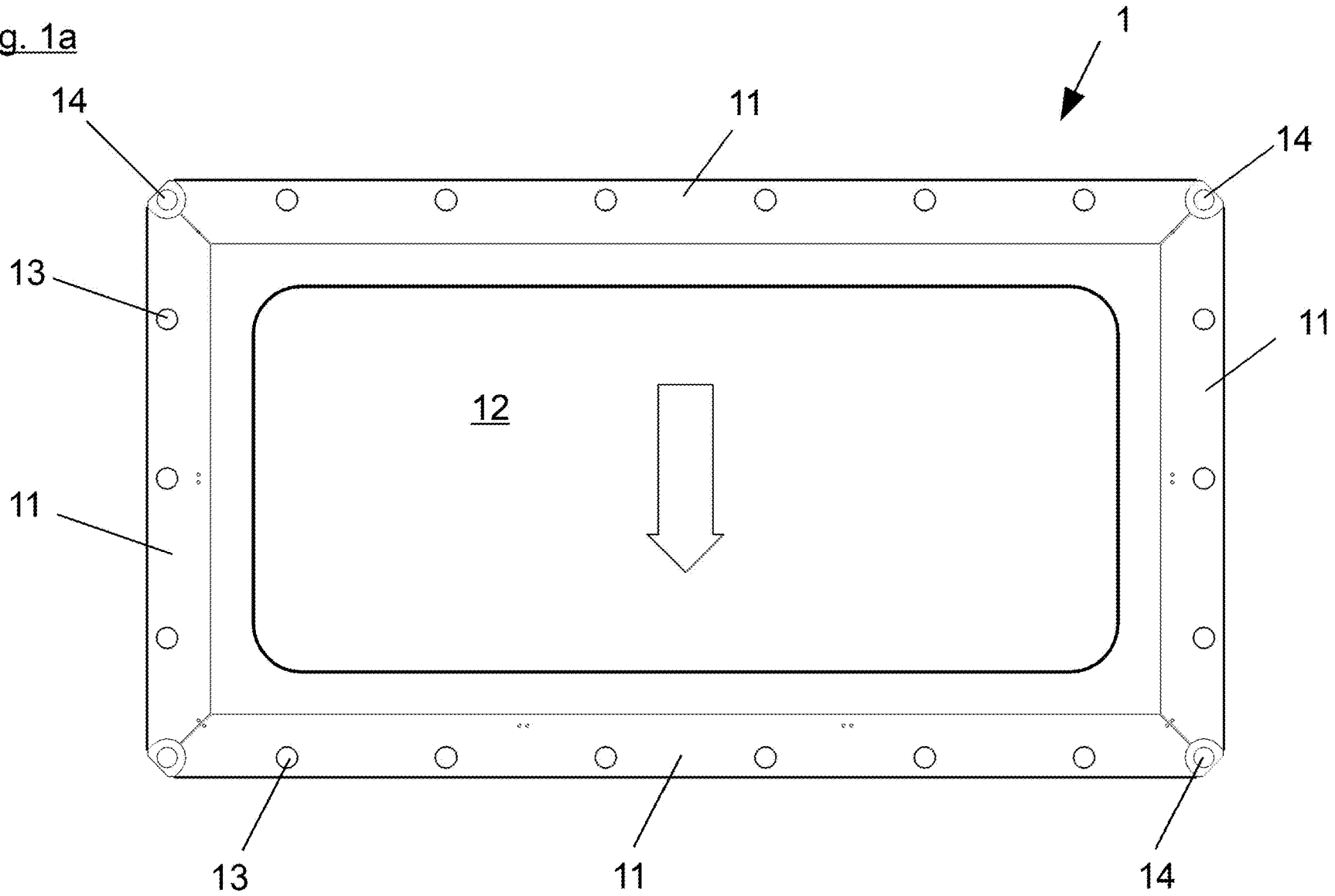
FIG. 1*a* shows a top view of the outside of the rupture disk.
Figure 2:
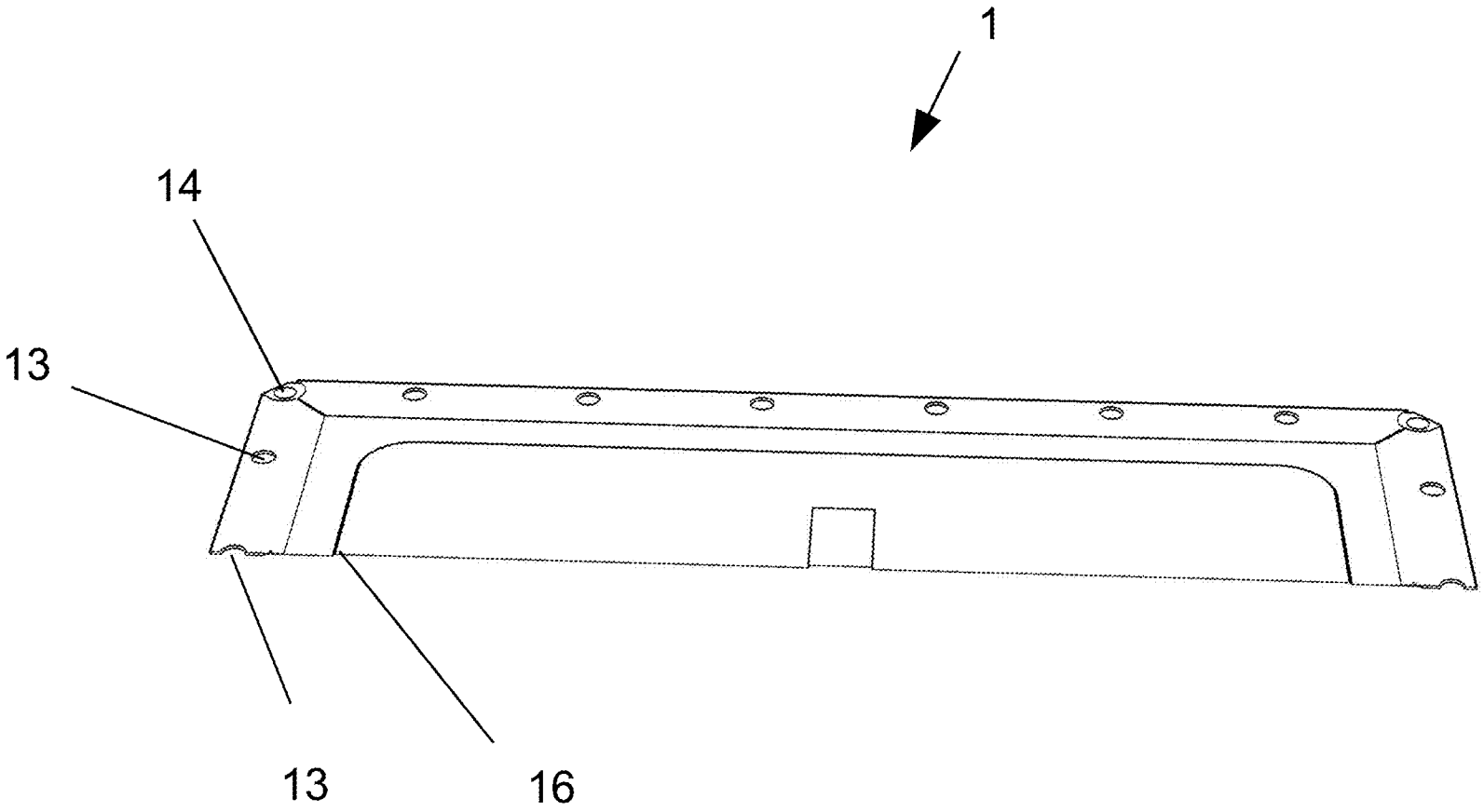
FIG. 2 shows a view of a cross-section through the rupture disk from the same perspective as in FIG. 1.
Figure 3:
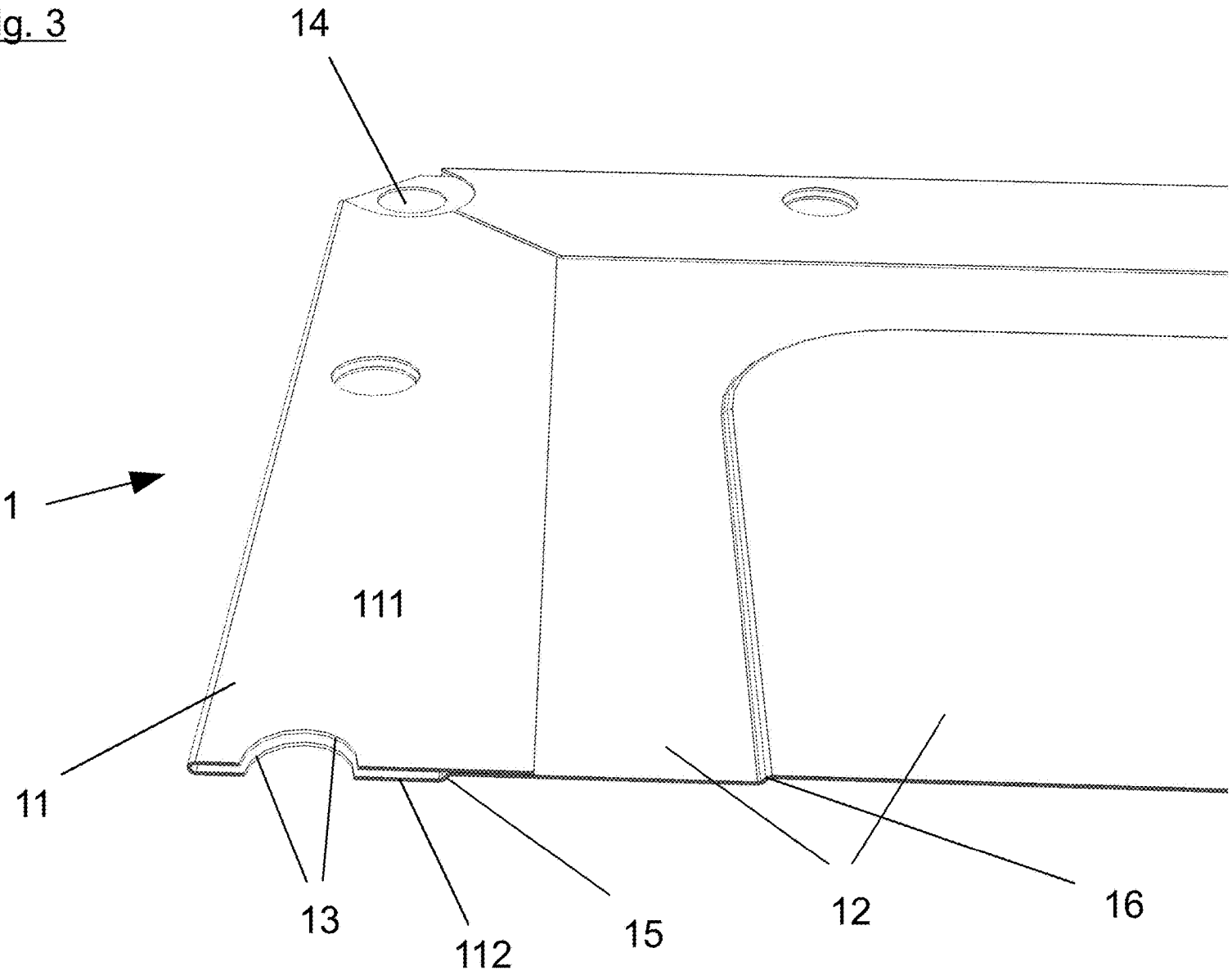
FIG. 3 shows an enlarged view of a section from FIG. 2.

It is not necessary for a device according to the disclosure to comprise all the features described below. It is also possible for a device according to the disclosure to have only individual features of the embodiment example described below.

Referring to FIGS. 1, 1*a*, 2, 3, and 4, a rupture disk 1 is made from a sheet metal that has been cut to size in a special way. The sheet metal is notched at the corners. The sheet metal is provided with a first shoulder area 15 and a second shoulder area 16 by a setting tool. The first shoulder area 15 is introduced into the sheet metal in a more outwardly location and the second shoulder area 16 in a more inwardly location. In addition, pairs of holes 13 have been introduced in the sheet metal, wherein the holes 13 are the same size. The two holes 13 of a pair are equally spaced on a line perpendicular to a straight line along which the sheet is bent through 180° to create a fold-over in order to thus produce an edge region 11 of the sheet metal. After the folding over, the holes 13 of a pair are one on top of the other and align. Additional holes 14 are provided in the sheet metal at the corners. All these holes 13, 14 are used to attach the rupture disk 1, which rupture disk can be screwed to a container or a conduit using screws that can be passed through these holes 13, 14.

A middle region 12 of the rupture disk 1 is formed within the edge region 11, in which central region the second shoulder area 16 is provided. The first shoulder area is located in the edge region 11.

Two parts 111, 112 of the sheet metal are formed in the edge region 11 by the fold-over, namely a first folded over part 111 and a second part 112 parallel to the folded over part 111. The first shoulder area 15 is formed in the second part 112. As a result, there is a region in which the first part 111 and the second part 112 are at a distance from each other, and a region located further inwards in which the first part 111 and the second part 112 lie against each other. In this region, in which the first part 111 and the second part 112 lie against each other, predetermined breaking lines (not shown) are provided, along which the rupture disk 1 ruptures and opens when a bursting pressure is reached.

In practice, it may be that the first part 111 and the second part 112 lie next to each other in regions between the fold-over and the shoulder area 15. For this purpose, these regions can be curved towards each other, in particular where the holes 13 are provided, however also in a region adjacent to the fold. This curvature can already be produced during the manufacture of the rupture disk, for example during folding. However, it is also possible that the curvature is only created when the rupture disk is assembled, when screws guided through the holes 13 are tightened and the first part 111 and the second part 112 are thereby pressed against each other.

Figure 4:
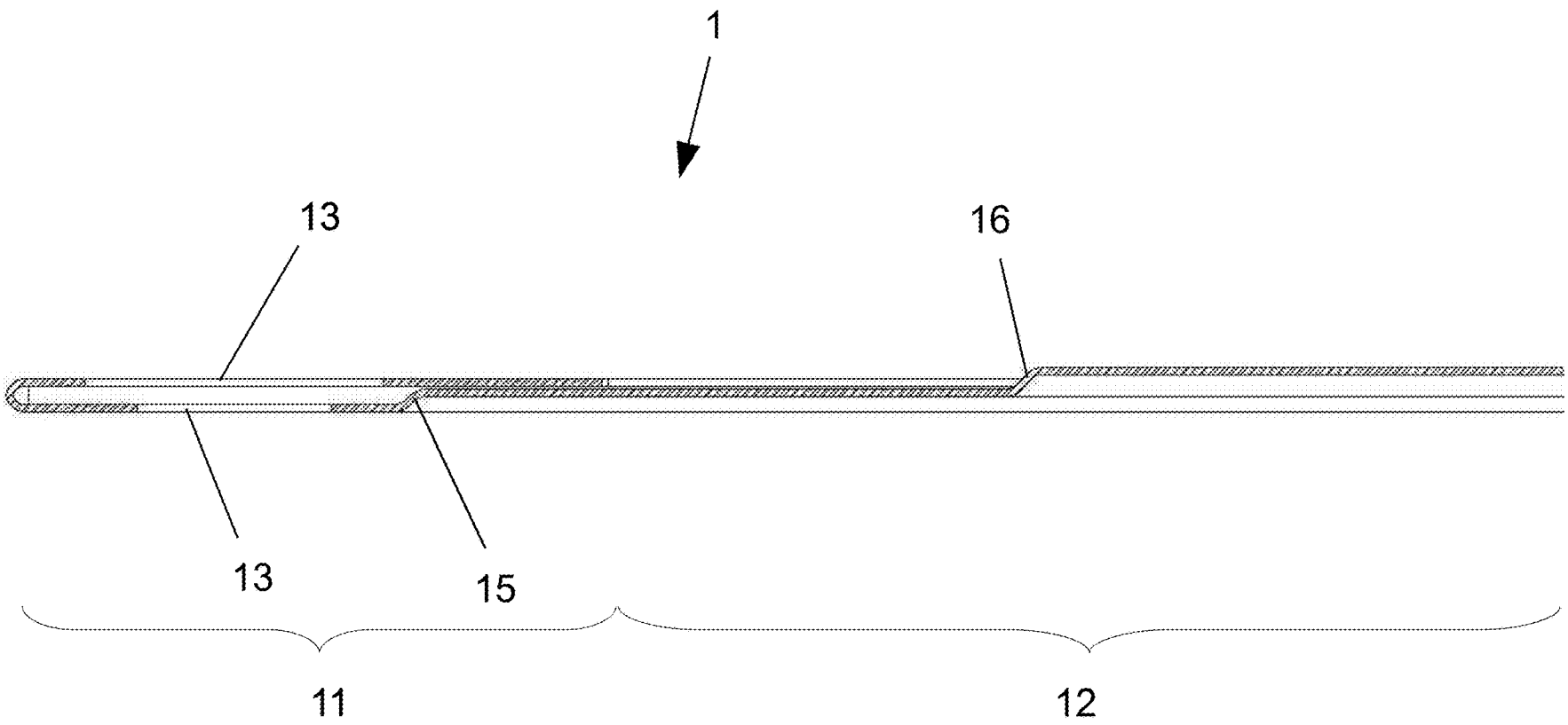
FIG. 4 shows a section of a view of the same cross-section in a top view.
Figure 4A:
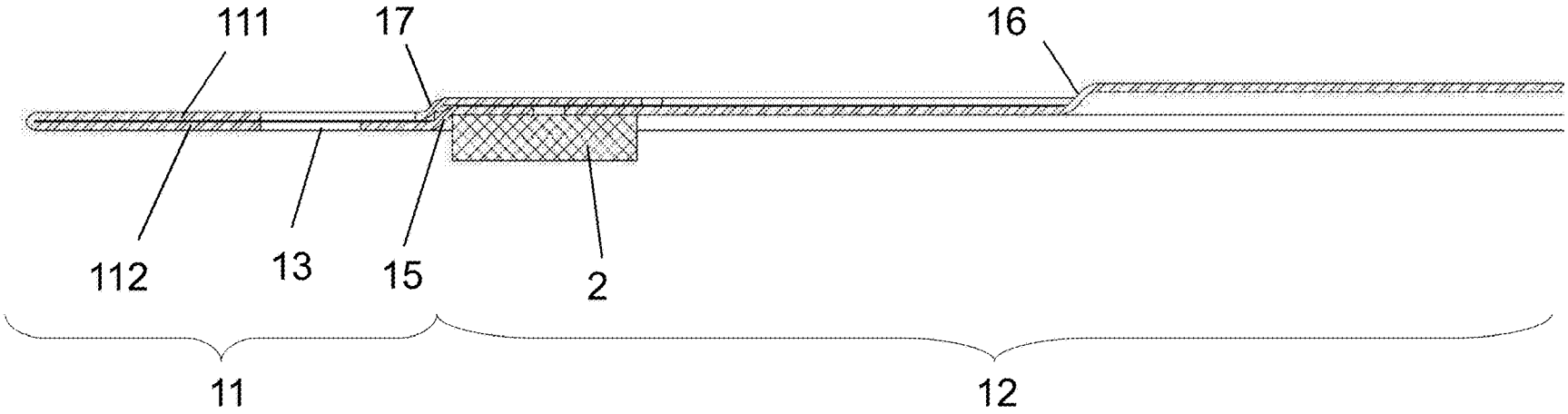
FIG. 4*a* shows a section from a view of a corresponding cross-section in a top view of a second rupture disk according to the disclosure.
Figure 4B:
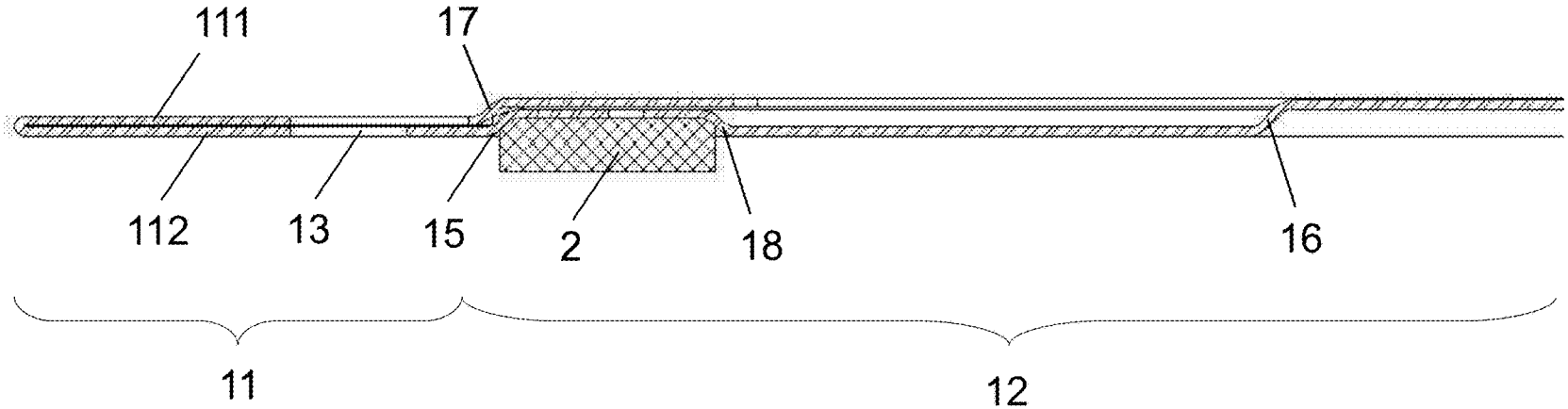
FIG. 4*b* shows a section from a view of a corresponding cross-section in a top view of a third rupture disk according to the disclosure.

Both in the second rupture disk according to FIG. 4*a* and in the rupture disk according to FIG. 4*b*, which apart from the differences shown correspond to the rupture disk according to FIG. 1 through FIG. 4, the first part 111 and the second part 112 lie against each other. For this purpose, in the second rupture disk according to FIG. 4*a* and also in the third rupture disk according to FIG. 4*b*, a third shoulder area 17 is formed in the first part 111 of the edge region 11 by a setting tool, which third shoulder area nestles up against the first shoulder area 15. The first shoulder area 15 and the third shoulder area 17 can be produced in a single operation if the fold-over has been produced first.

In the case of the third rupture disk, a fourth shoulder area 18 is provided in the first region in addition to the first shoulder area 15, the second shoulder area 16, and the third shoulder area 17 in the second part 112 of the edge region 11, which fourth shoulder area is oriented in the opposite direction to the first shoulder area 15. This forms a circumferential depression in the second part 112 of the edge region 11.

In the three rupture disks 1 shown, a seal 2 can be arranged on the first shoulder area 15 adjacent to the second part 112 of the edge region 11, which seal, when the rupture disk 1 is mounted, rests against the edge of an opening to be closed and seals a gap between the rupture disk 1 and the edge of the opening. The first shoulder area 15 prevents this seal 2 from being compressed so much during assembly that it is damaged and then possibly no longer fulfills its sealing purpose. The seal 2 can be a sealing strip that is affixed to the second part 112. Alternatively, it can also be a foamed seal 2 that is molded on. In the case of the third rupture disk 1, the circumferential recess limits the location on both sides in which the seal 2 can be arranged.

What is claimed is:

1. A rectangular rupture disk, comprising:

a sheet metal comprising:

an edge region with which the rupture disk is fastenable to an opening of a container or of a conduit, the rupture disk comprising in the edge region a fold-over including a first folded over part of the sheet metal and a second part of the sheet metal to which the first folded over part is parallel;

a first shoulder area located in the second part of the sheet metal;

a central region with which the opening is sealable until the container or conduit reaches a bursting pressure; and predetermined breaking lines along which the rupture disk ruptures to at least partially open the central region in response to the container or conduit reaching the bursting pressure, wherein:

in a region between an outer edge of the rupture disk and the first shoulder area, either a space lies between the first folded over part and the second part, or the first folded over part and the second part lie against each other, and inboard of the first shoulder area, the first folded over part and the second part lie against each other.

2. The rupture disk of claim 1, wherein the fold-over includes holes to receive screws to secure the rupture disk to an edge of the opening.

3. The rupture disk of claim 1, further comprising a second shoulder area in the central region at a distance from the fold-over.

4. The rupture disk of claim 3, wherein the first shoulder area and the second shoulder area extend out of a plane of the second part to a same side of the plane of the second part.

5. A rectangular rupture disk, comprising:

a sheet metal comprising:

an edge region with which the rupture disk is fastenable to an opening of a container or of a conduit, the rupture disk comprising in the edge region a fold-over including a first folded over part of the sheet metal and a second part of the sheet metal to which the first folded over part is parallel, wherein the fold-over includes holes to receive screws to secure the rupture disk to an edge of the opening;

a first shoulder area located in the second part of the sheet metal;

a central region with which the opening is sealable until the container or conduit reaches a bursting pressure; and predetermined breaking lines along which the rupture disk ruptures to at least partially open the central region in response to the container or conduit reaching the bursting pressure, wherein a space lies between the first folded over part and the second part in a region between an outer edge of the rupture disk and the first shoulder area, and the first folded over part and the second part lie against each other inboard of the first shoulder area.

6. The rupture disk of claim 5, further comprising a second shoulder area in the central region at a distance from the fold-over.

7. The rupture disk of claim 6, wherein the first shoulder area and the second shoulder area extend out of a plane of the second part to a same side of the plane of the second part.

8. A rectangular rupture disk, comprising:

a sheet metal comprising:

an edge region with which the rupture disk is fastenable to an opening of a container or of a conduit, the rupture disk comprising in the edge region a fold-over including a first folded over part of the sheet metal and a second part of the sheet metal to which the first folded over part is parallel;

a first shoulder area located in the second part of the sheet metal;

a central region with which the opening is sealable until the container or conduit reaches a bursting pressure; and predetermined breaking lines along which the rupture disk ruptures to at least partially open the central region in response to the container or conduit reaching the bursting pressure, wherein a space lies between the first folded over part and the second part in a region between an outer edge of the rupture disk and the first shoulder area, and the first folded over part and the second part lie against each other inboard of the first shoulder area.

9. The rupture disk of claim 8, further comprising a second shoulder area in the central region at a distance from the fold-over.

10. The rupture disk of claim 9, wherein the first shoulder area and the second shoulder area extend out of a plane of the second part to a same side of the plane of the second part.

* * * * *